US011825260B2

(12) United States Patent
Liu

(10) Patent No.: US 11,825,260 B2
(45) **Date of Patent: *Nov. 21, 2023**

(54) EARPHONE

(71) Applicant: SHENZHEN HEYTAP TECHNOLOGY CORP., LTD., Guangdong (CN)

(72) Inventor: Bo Liu, Guangdong (CN)

(73) Assignee: SHENZHEN HEYTAP TECHNOLOGY CORP., LTD., Guangdong (CN)

( * ) Notice: Subject to any disclaimer, the term of this patent is extended or adjusted under 35 U.S.C. 154(b) by 133 days.

This patent is subject to a terminal disclaimer.

(21) Appl. No.: 17/542,037

(22) Filed: Dec. 3, 2021

(65) Prior Publication Data

US 2022/0095034 A1 Mar. 24, 2022

Related U.S. Application Data

(63) Continuation-in-part of application No. 16/880,511, filed on May 21, 2020, now Pat. No. 11,197,080.

(30) Foreign Application Priority Data

May 28, 2019 (CN) ..... 201910449252.5
May 28, 2019 (CN) ..... 201920788583.7

(51) Int. Cl.
*H04R 1/10* (2006.01)
*H04R 1/28* (2006.01)
*H04R 11/02* (2006.01)

(52) U.S. Cl.
CPC ..... *H04R 1/1016* (2013.01); *H04R 1/1075* (2013.01); *H04R 1/1091* (2013.01); *H04R 1/2826* (2013.01); *H04R 11/02* (2013.01)

(58) Field of Classification Search
CPC ..... H04R 1/10; H04R 1/1016; H04R 1/1041; H04R 1/1058; H04R 1/1075;
(Continued)

(56) References Cited

U.S. PATENT DOCUMENTS 10,986,433 B2 * 4/2021 McIntosh ..... H05K 5/0086
11,197,080 B2 * 12/2021 Liu ..... H04R 1/1075
(Continued)

FOREIGN PATENT DOCUMENTS

CN 202004931 10/2011
CN 202587329 12/2012
(Continued)

OTHER PUBLICATIONS

WIPO, International Search Report and Written Opinion for PCT/CN2020/089854, dated Jul. 29, 2020.
(Continued)

*Primary Examiner* — Thang V Tran
(74) *Attorney, Agent, or Firm* — Hodgson Russ LLP

(57) ABSTRACT

An earphone includes a housing, a first eartip, and a second eartip. The earphone has a first use state and a second use state. In the second state, the second eartip engages with the housing and a vent channel is provided to communicate with an inner space of the housing and an exterior of the earphone. In the first state, the first eartip engages with the housing and the vent channel is blocked. A distance of the first eartip inserted into an auditory meatus in the first state is less than a distance of the second eartip inserted into the auditory meatus in the second state.

20 Claims, 10 Drawing Sheets

(58) Field of Classification Search
CPC ..... H04R 1/1091; H04R 1/28; H04R 1/2823; H04R 1/2826; H04R 1/2846; H04R 1/2849; H04R 11/02; H04R 2460/09; H04R 2460/11; H04R 25/60; H04R 25/65; H04R 25/652; H04R 25/656
See application file for complete search history.

(56) References Cited

U.S. PATENT DOCUMENTS

| | | | | |
|---|---|---|---|---|
| 2012/0207337 | A1 | 8/2012 | Tiscareno et al. | |
| 2012/0217087 | A1* | 8/2012 | Ambrose | H04R 1/1016 181/130 |
| 2013/0148830 | A1* | 6/2013 | Sakaguchi | H04R 1/2873 381/338 |
| 2017/0094384 | A1 | 3/2017 | Trainer et al. | |
| 2017/0188133 | A1* | 6/2017 | Olson | H04R 1/1066 |
| 2018/0070165 | A1 | 3/2018 | Hatfield et al. | |
| 2018/0295455 | A1* | 10/2018 | Eichfeld | H04R 25/652 |

FOREIGN PATENT DOCUMENTS

| | | |
|---|---|---|
| CN | 204578734 | 8/2015 |
| CN | 105451109 | 3/2016 |
| CN | 205142465 | 4/2016 |
| CN | 205622807 | 10/2016 |
| CN | 205793193 | 12/2016 |
| CN | 108429971 | 8/2018 |
| CN | 210093459 | 2/2020 |

OTHER PUBLICATIONS

EPO, Extended European Search Report for EP Application No. 20174549.4, dated Sep. 28, 2020.
IPI, Office Action for IN Application No. 202014020925, dated Jun. 29, 2021.
CNIPA, Notification to Grant Patent Right for Utility Model for CN Application No. 201920788583.7, dated Nov. 5, 2019.
EPO, Office Action for EP Application No. 20174549.4, dated Dec. 7, 2022.

* cited by examiner

EARPHONE

CROSS-REFERENCE TO RELATED APPLICATION

This application is a continuation-in-part of U.S. patent application Ser. No. 16/880,511, filed May 21, 2020, which claims priority to Chinese Patent Application No. 201920788583.7, filed May 28, 2019, and priority to Chinese Patent Application No. 201910449252.5, filed May 28, 2019. The entire disclosures of the aforementioned applications are incorporated herein by reference.

TECHNICAL FIELD

The present disclosure relates to the field of earphones in general. More particularly, and without limitation, the disclosed embodiments relate to earphone.

BACKGROUND

Nowadays, entertainments such as listening to music and watching movies have become one of the important ways to relax for people, and earphones are usually needed in such entertainments.

BRIEF DESCRIPTION OF THE DRAWINGS

In order to explain the technical solutions in the embodiments of the present disclosure or the prior art more clearly, the drawings used in the description of the embodiments or the prior art are briefly introduced below. Obviously, the drawings in the following description are merely some embodiments of the present disclosure. For those of ordinary skill in the art, other drawings can be obtained according to these drawings without paying creative labor.

DETAILED DESCRIPTION OF EMBODIMENTS

Figure 1:
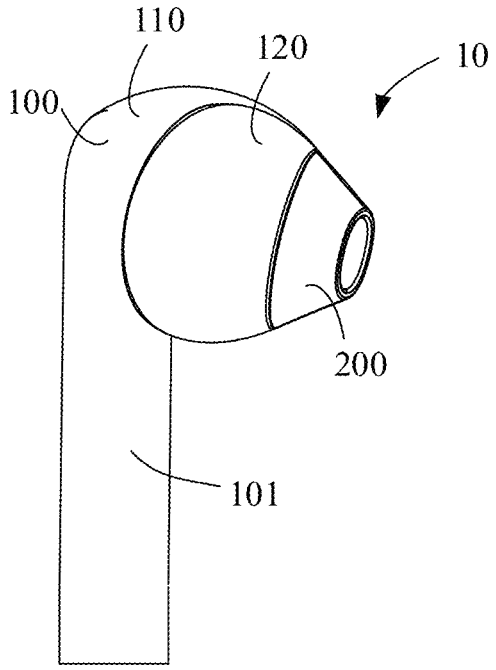
FIG. 1 illustrates a perspective view of an earphone with a first eartip mounted on a housing of the earphone, in accordance with an embodiment of the present disclosure.

In order to facilitate understanding of the present disclosure, the present disclosure will be described more fully with reference to the related drawings. The drawings show the preferred embodiments of the present disclosure. However, this disclosure can be implemented in many different forms and is not limited to the embodiments described herein. Rather, these embodiments are provided to provide a thorough and comprehensive understanding of the disclosure of this disclosure.

As illustrated in FIGS. 1 to 4, an earphone 10 is provided according to an embodiment of the present disclosure. The earphone 10 includes a handheld part 101, a housing 100, a first eartip 200, a second eartip 300, and a speaker 130 (illustrated in FIG. 9). The first eartip 200 and the second eartip 300 is configured to detachably cooperate with the housing 100 to change a configuration of the earphone 10. The speaker 130 is received in the housing 100. The handheld part 101 is cylindrical, smooth in feel, and used for a user to hold the earphone 10 conveniently.

Figure 3:
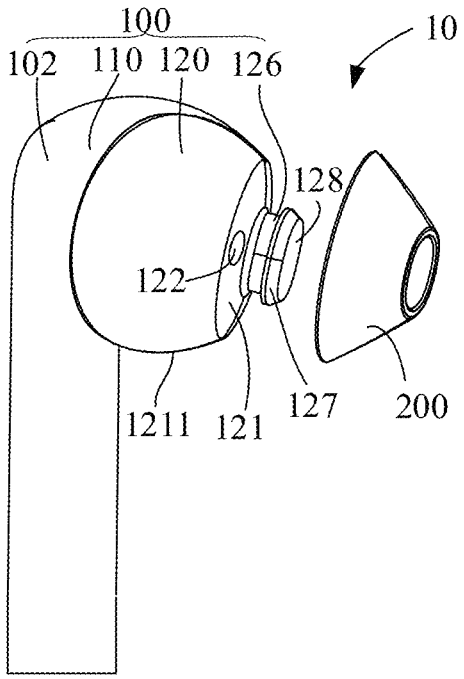
FIG. 3 illustrates a perspective view of the earphone of FIG. 1, wherein the first eartip is apart from the housing.

As illustrated in FIGS. 1 and 3, the first eartip 200 is flexible and can be assembled to and detached from the housing 100. In some embodiments, the first eartip 200 is made of silicon.

Figure 2:
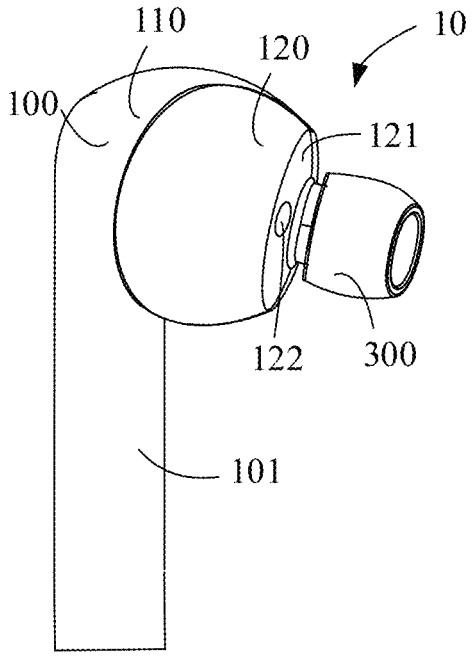
FIG. 2 illustrates a perspective view of an earphone with a second eartip mounted on the housing of the earphone, in accordance with another embodiment of the present disclosure.
Figure 4:
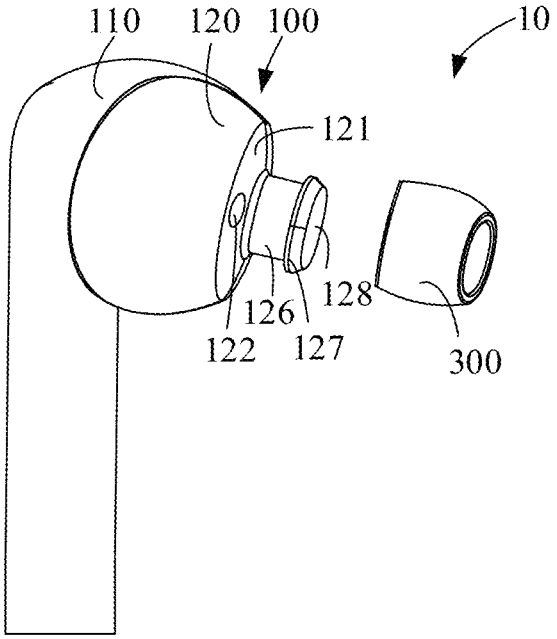
FIG. 4 illustrates a perspective view of the earphone of FIG. 2, wherein the second eartip is apart from the housing.

As illustrated in FIGS. 2 and 4, the second eartip 300 is flexible, and can be assembled to and detached from the housing 100. A distance that the first eartip 200 extends in an auditory meatus 20 of the user is smaller than a distance that the first eartip 300 extends in the auditory meatus 20 when the earphone 10 is worn by the user. In some embodiments, the second eartip 300 is made of silicon. When the second eartip 300 is assembled to the housing 100, an inner space of the housing 100 can communicate with the exterior, thus the housing 100 is easy to ventilate.

Figure 5:
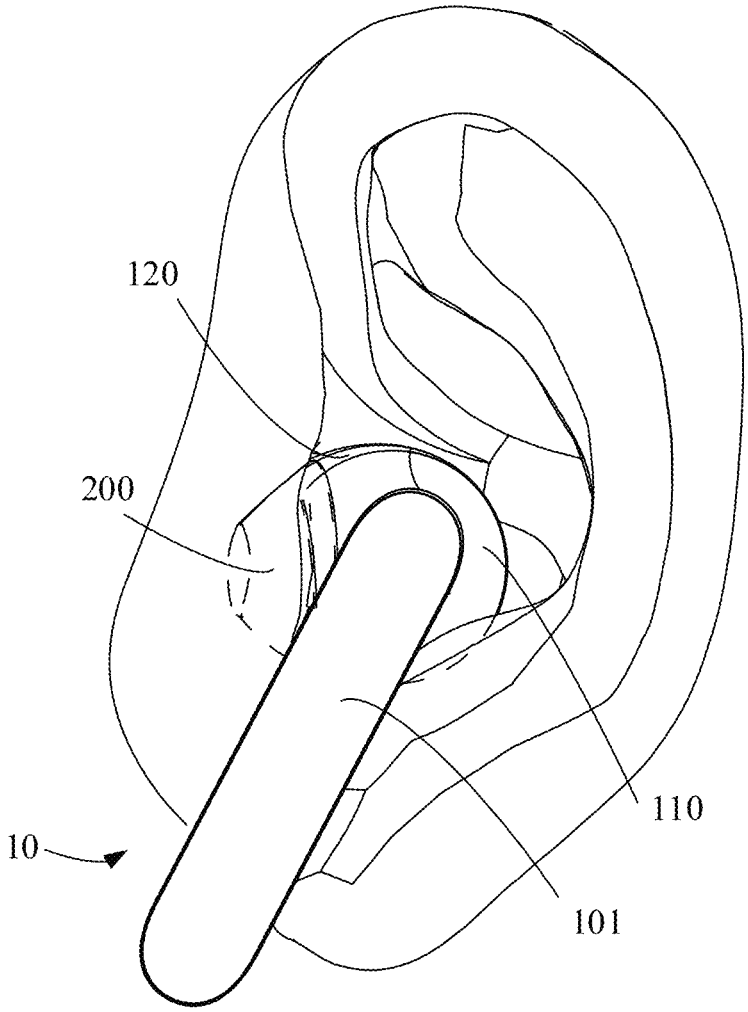
FIG. 5 illustrates a perspective view of the earphone of FIG. 1 in a working state.
Figure 6:
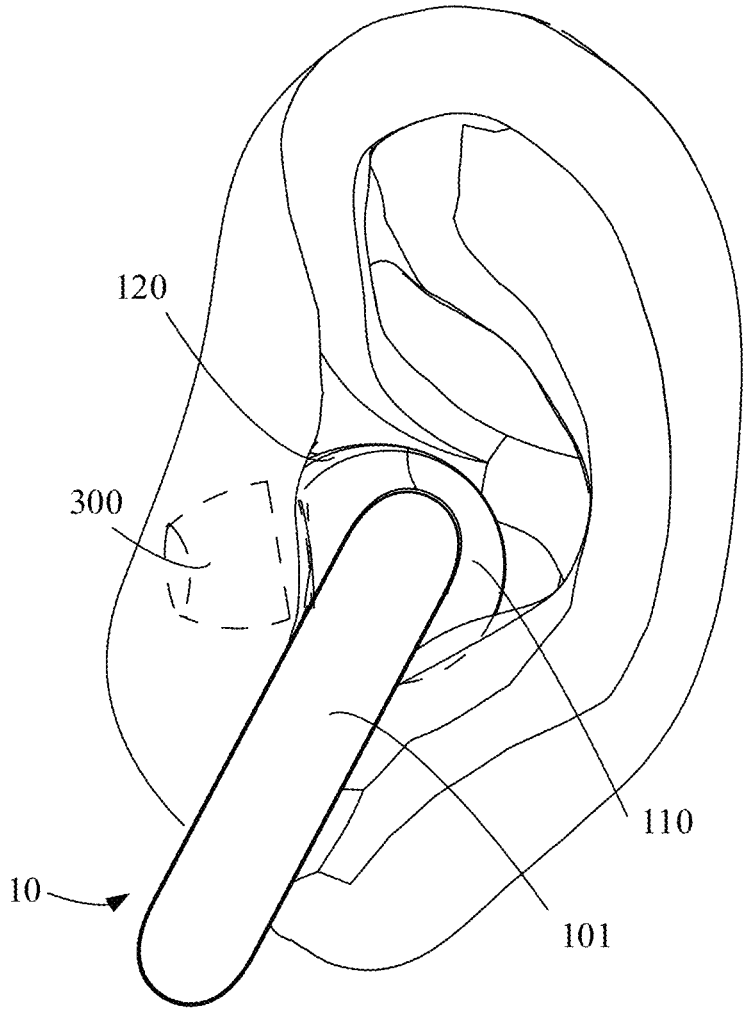
FIG. 6 illustrates a perspective view of the earphone of FIG. 2 in a working state.

The first eartip 200 and the second eartip 300 have different structures. When the first eartip 200 is assembled to the housing 100, the earphone 10 has a structure of a semi-in-ear earphone. As illustrated in FIG. 5, when the user wears the earphone 10 with the first eartip 200, the first eartip 200 is inserted into the auditory meatus 20, and a depth that the earphone 10 extends in the auditory meatus 20 is relatively small. When the second eartip 300 is assembled to the housing 100, the earphone 10 has a structure of an in-ear earphone. As illustrated in FIG. 6, when the user wears the earphone 10 with the second eartip 300, the second eartip 300 inserts into the auditory meatus 20, and a depth that the earphone 10 extends in the auditory meatus 20 is larger than that of the first eartip 200.

The first eartip 200 and the second eartip 300 have different structures, and the earphone 10 can switch between two configurations by equipping with the first eartip 200 or the second eartip 300. The two configurations include a first configuration and a second configuration. In the first configuration, the first eartip 200 is engaged with the housing 100, and the first eartip 200 is deformed and in contact with the auditory meatus 20 when received in the auditory meatus 20. In the second configuration, the second eartip 300 is engaged with the housing 100, and the second eartip 300 is deformed and in contact with the auditory meatus 20 when received in the auditory meatus 20. A distance that the first eartip 200 extends in the auditory meatus is smaller than a distance that the first eartip 200 extends in the auditory meatus when received in the auditory meatus 20.

In some embodiments, the first eartip 200 has an asymmetric structure, and the second eartip 300 has a symmetric structure. For example, the first eartip 200 is irregular, and the second eartip 300 is cylindrical in an outer shape. As such, the first configuration is different from the second configuration. It is noted that the specific structure of the first eartip 200 and/or the second eartip 300 can be designed according to actual requirements.

Figure 7:
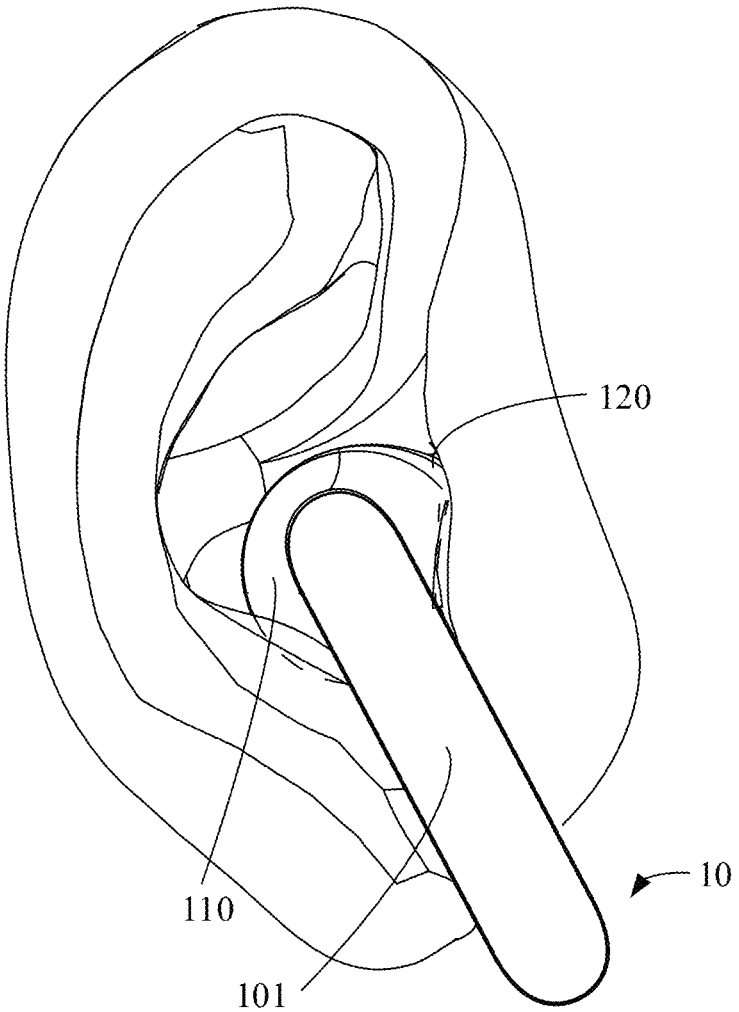
FIG. 7 illustrates a perspective view of an earphone in a working state, in accordance with still another embodiment of the present disclosure.
Figure 8:
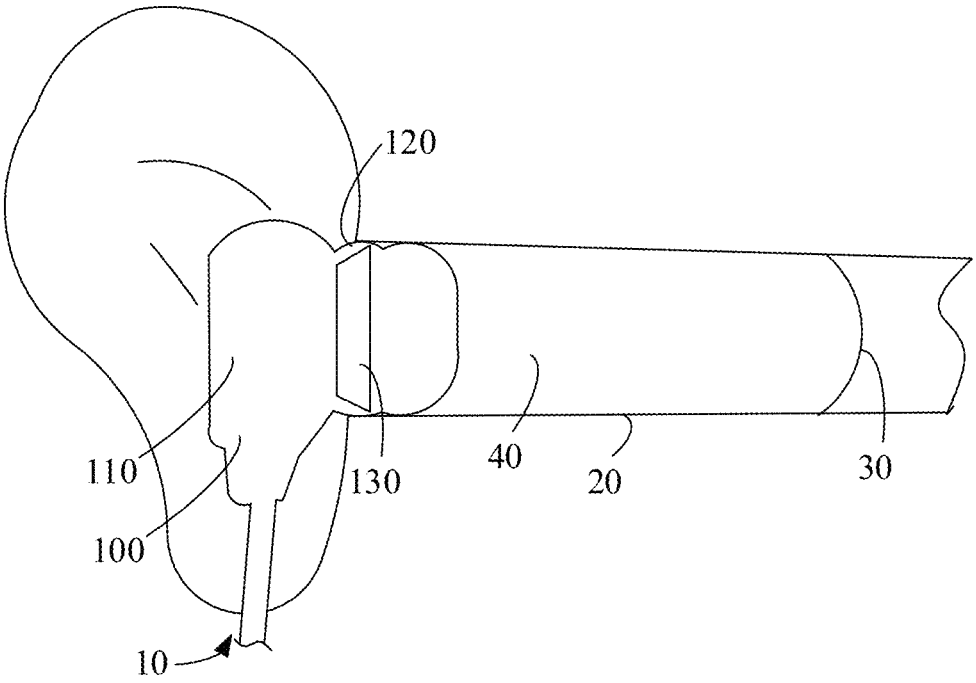
FIG. 8 illustrates a cross-sectional view of the earphone of FIG. 7.

As illustrated in FIG. 7 and FIG. 8, when the user wears the earphone 10 normally, the speaker 130, the housing 100, the auditory meatus 20, and an eardrum 30 of the user cooperatively form a front cavity 40. The acoustic characteristics of the front cavity 40 directly affect the acoustic performance of the earphone 10. The acoustic characteristics of the front cavity 40 mainly include the entire volume and airtightness thereof. The acoustic performance of the earphone 10 mainly includes a frequency response and a resonance frequency. The airtightness of the front cavity 40 of a semi-in-ear headphone and the airtightness of an in-ear headphone are significant different. Therefore, under same conditions, there is a significant difference in the acoustic performances of the semi-in-ear headphone and the in-ear headphone. By changing the airtightness of the front cavity 40, that is, the acoustic performance of the earphone 10 can be changed by adjusting the airtightness in the auditory meatus 20.

In the earphone 10 of the present disclosure, the first eartip 200 and the second eartip 300 can be detachably assembled to the housing 100, which can change the distance that the earphone 10 extends in the auditory meatus. So that the earphone 10 can switch between a semi-in-ear earphone and an in-ear earphone, and the acoustic characteristics of the front cavity 40 may be adjusted, thereby adjusting the acoustic performance of the earphone 10.

When the first eartip 200 is mounted on the housing 100, the earphone 10 works as a semi-in-ear earphone. When the user wears the earphone 10 with the first eartip 200, the first eartip 200 is at least partially received in the auditory meatus 20, so it would not generate pressure on the auditory meatus 20 of the user thereby providing good experience for the user, moreover the first eartip 200 is not easily fall off from the ear. When the first eartip 200 is received in the auditory meatus 20, the first eartip 200 can cooperate well with the auditory meatus 20, which may achieve a good sound insulation, and makes the airtightness of the front cavity 40 better, and improves the acoustic performance of the earphone 10.

The earphone 10 defines a vent channel, the vent channel is configured to ventilate the housing 100 or the front cavity 40 when the second eartip 300 is mounted on the housing 100. In one embodiment, the vent channel may be a through hole defined in the housing 100, and the through hole may be in communication with the outside of the housing 100. In another embodiment, the vent channel may be a notch defined in the housing 100 or defined in the second eartip 300, and the notch may be in communication with the inner space of the housing 100 and the outside of the housing 100. In still another embodiment, the vent channel may be a gap defined between the housing 100 and the second eartip 300, and the gap may be in communication with the inner space of the housing 100 and the outside of the housing 100.

When the second eartip 300 is mounted on the housing 100, the earphone 10 works as an in-ear earphone. When the user wears the earphone 10 with the second eartip 300, the second eartip 300 is at least partially received in the auditory meatus 20, the vent channel is in communication with the auditory meatus 20, thereby reducing or avoiding to generate pressure on the auditory meatus 20 of the user and providing good experience for the user, moreover the second eartip 300 is not easily fall off from the ear of the user. When the second eartip 300 is mounted on the housing 100, the vent channel can reduce the airtightness of the front cavity 40, thereby avoiding a pressure difference generated between the auditory meatus 20 and the exterior. As such, echoes of sounds when the user speaking are avoided, and a sound quality of the earphone 10 is improved. When the second eartip 300 is assembled to the housing 100, the depth that the earphone 10 extends in the auditory meatus 20 is smaller than that of conventional in-ear earphones. Therefore, an intrusive feeling when the user wears the earphone 10 can be weakened in a certain. The airtightness of the front cavity 40 that is defined by the earphone 10 equipped with the first eartip 200 is substantially approximate to the airtightness of the front cavity 40 that is defined by the earphone 10 equipped with the second eartip 300, that is, the earphone 10 may have similar acoustic characteristics in both conditions of the earphone 10 when equipped with the first eartip 200 or the second eartip 300, and sound qualities of the earphone 10 in both the two conditions are not easily affected.

In other words, the earphone 10 has a first use state and a second use state. In the second state, the second eartip 300 engages with the housing 100, the earphone 10 works as a semi-in-ear earphone, and the vent channel is provided to communicate with the inner space and the exterior of the earphone 10. In the first state, the first eartip 200 engages with the housing 100, the earphone 10 works as an semi-in-ear earphone, and the vent channel is blocked. A distance of the first eartip 200 inserted into the auditory meatus 20 in the first state is less than a distance of the second eartip 300 inserted into the auditory meatus 20 in the second state. The in-ear earphone generally tightly fits the auditory meatus of the user, the vent channel can communicate the inner space and the exterior of the earphone 10, so any air pressure generated in the auditory meatus may be released and the user experience can be improved. The semi-in-ear earphone generally does not fit the auditory meatus very tightly relative to the in-ear earphone, so even no vent channel is provided when the earphone 10 works as the semi-in-ear earphone, the user may not feel the discomfort caused by the air pressure in the auditory meatus.

Figure 9:
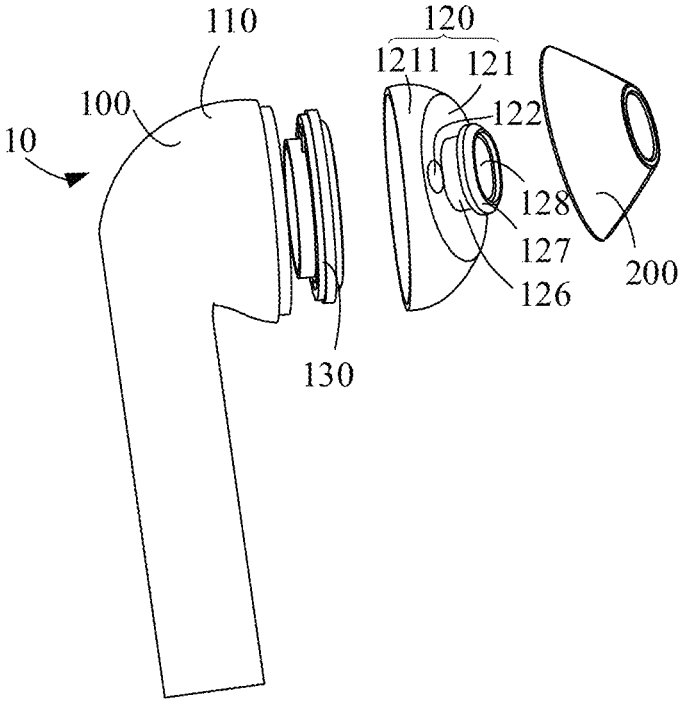
FIG. 9 illustrates an exploded view of the earphone of FIG. 1.
Figure 10:
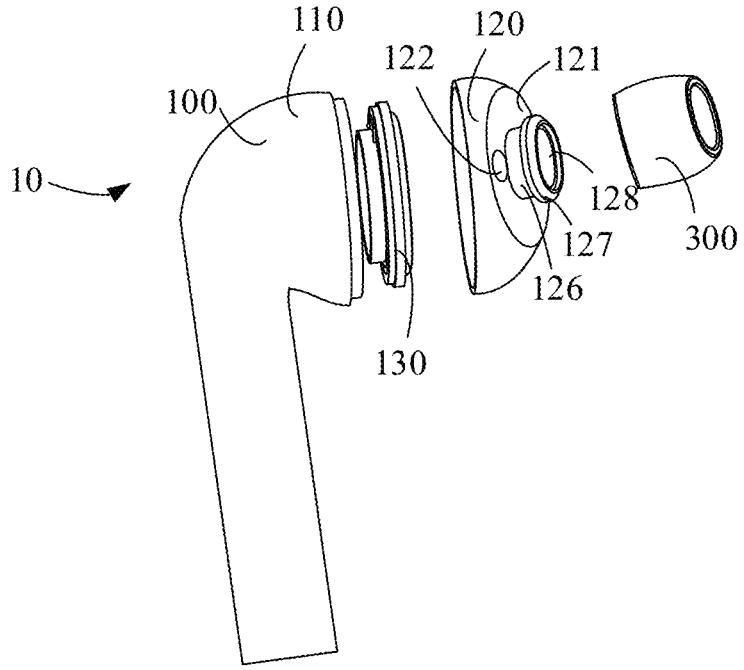
FIG. 10 illustrates an exploded view of the earphone of FIG. 2.

As illustrated in FIGS. 9 and 10, the housing 100 includes a coupled portion 102, a rear case 110, a front cover 120 coupled to the rear case 110, and a sound emitting nozzle 126 protruded from the front cover 120. A central axis of the handheld part 101 is substantially perpendicular to a central axis of the coupled portion 102. The coupled portion 102 is coupled between the handheld part 101 and the rear case 110. The rear case 110 is tightly engaged between the coupled portion 102 and the front cover 120. The coupled portion 102, the rear case 110 and the front cover 120 cooperatively define an inner space 105 of the earphone 10. The coupled portion 102, the rear case 110 and the front cover 120 cooperatively constitute a body of the housing 100. The speaker 130 is disposed in the inner space 105. A sound emitting part of the speaker 130 faces the front cover 120. The front cover 120, the coupled portion 102 and the rear case 110 are made of plastic, synthetic resin, or metal. The housing 100 is rigid and not easy to be deformed, so electronic components, e.g., the speaker 130, accommodated in the housing 100 can be protected by the housing 100. The housing 100 can be regular or irregular in shape. In another embodiment, the housing 100 may be integrally-formed or manufactured by integrated molding.

The front cover 120 includes an exterior end surface 121 and an exterior side surface 1211 connected with the end surface 121. The end surface 121 is positioned at an end of the front cover 120 and away from the rear case 110. The side surface 1211 is connected with an outer periphery of the end surface 121 to form a portion of an outer surface of the housing 100.

The sound emitting nozzle 126 protrudes from the end surface 121 towards a direction far away from the rear case 110. The sound emitting nozzle 126 is hollow for allowing sounds from the speaker 130 to transmit therethrough. In some embodiments, the sound emitting nozzle 126 is substantially cylindrical. The sound emitting nozzle 126 defines a first sound channel 128 communicating with the inner space 105. The sounds emitted from the speaker 130 may pass through the first sound channel 128 to the outside of the earphone 10, e.g., the front cavity 40. A central axis of the sound emitting nozzle 126 intersects with a central axis of the speaker 130, and also intersects with the central axis of the coupled portion 102.

In some embodiments, the housing 100 includes an engagement protrusion 127 protruded from the sound emitting nozzle 126. The engagement protrusion 127 is disposed on an end of the sound emitting nozzle 126 far away from the end surface 121. The engagement protrusion 127 protrudes from an exterior surface of the sound emitting nozzle 126, and configured to selectively engage with one of the first eartip 200 and the second eartip 300.

The engagement protrusion 127 is substantially annular and surrounds the sound emitting nozzle 126. An outer diameter of the engagement protrusion 127 is larger than an outer diameter of the sound emitting nozzle 126. When the first eartip 200 or the second eartip 300 is mounted on the housing 100, the engagement protrusion 127 engages with the first eartip 200 or the second eartip 300, thereby avoiding the first eartip 200 or the second eartip 300 to detach from the housing 100. In another embodiment, the engagement protrusion 127 may include one or more protrusions disposed on the exterior surface of the sound emitting nozzle 126. In still another embodiment, the sound emitting nozzle 126 may have other shapes or structures, for example, a cross-section of the sound emitting nozzle 126 may be regular or irregular, such as a triangular, quadrilateral, pentagonal, which is not limited herein. The sound emitting nozzle 126 and the front cover may be integrally formed, also may be respectively formed and assembled together. engagement protrusion In some embodiments, the housing 100 comprises the front cover 120 and the sound emitting nozzle 126, the sound emitting nozzle 126 protrudes from the front cover 120 towards a direction away from the front cover 120, the front cover 120 is in contact with the first eartip 200 when the first eartip 200 is mounted on the sound emitting nozzle 126 of the housing 100, and the front cover 120 is spaced apart from the second eartip 300 when the second eartip 300 is mounted on the sound emitting nozzle 126 of the housing 100.

In some embodiments, the housing 100 comprises the front cover 120 and the sound emitting nozzle 126, the front cover 120 comprises the end surface 121, the sound emitting nozzle 126 protrudes from the end surface 121 towards a direction away from the front cover 120, the end surface 121 is in contact with the first eartip 200 when the first eartip 200 is mounted on the sound emitting nozzle 126 of the housing 100, and the end surface 121 is spaced apart from the second eartip 300 when the second eartip 300 is mounted on the sound emitting nozzle 126 of the housing 100.

Figure 11:
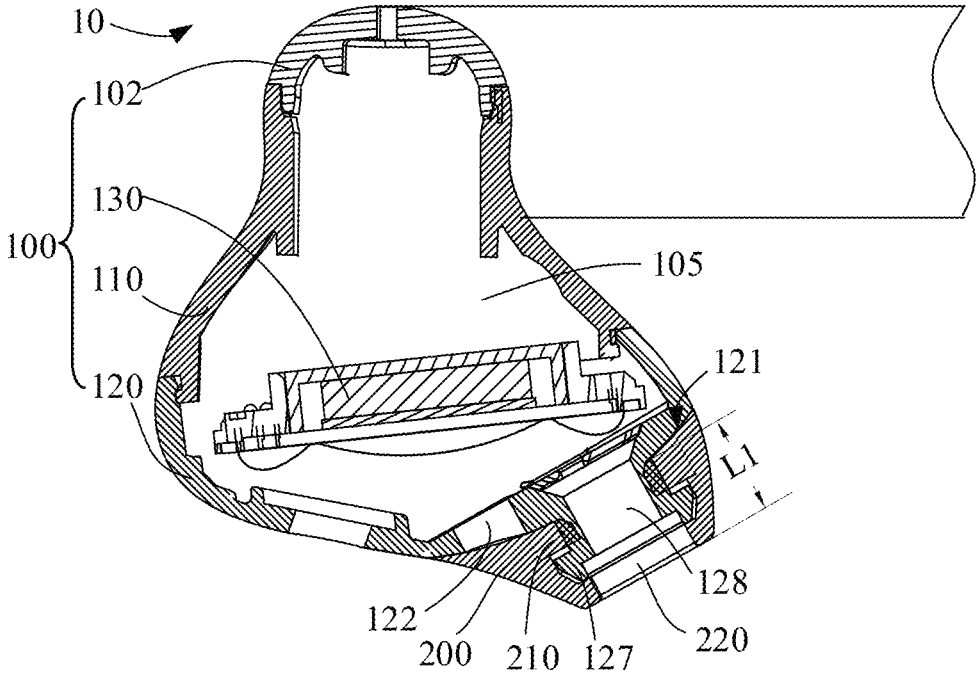
FIG. 11 illustrates a cross-sectional view of the earphone of FIG. 1.
Figure 12:
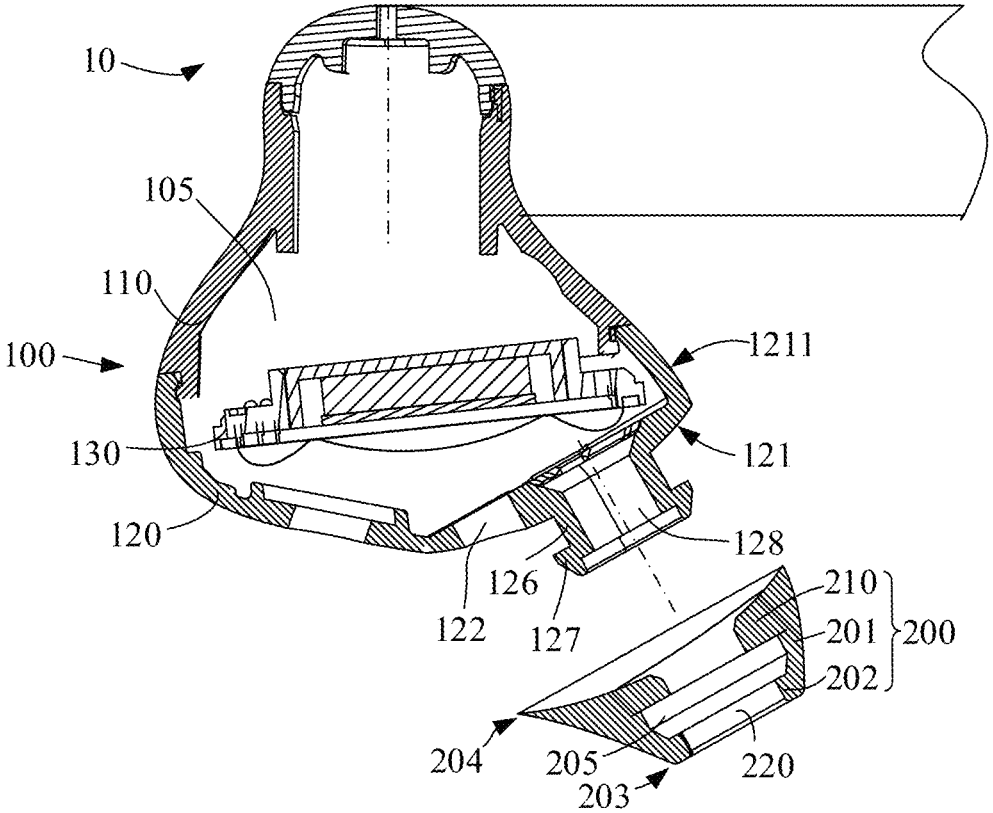
FIG. 12 illustrates a cross-sectional view of the earphone of FIG. 11, wherein the first eartip is apart from the housing.

As illustrated in FIGS. 11 and 12, the first eartip 200 can be mounted on and detached from the housing 100. The first eartip 200 defines a second sound channel 220 therein. When the first eartip 200 is mounted on the housing 100, the first sound channel 128 is in communication with the second sound channel 220. So that the sounds emitted from the speaker 130 can pass through the first sound channel 128 and the second sound channel 220, and then can be transmitted to the outside of the earphone 10, for example, can be transmitted to the front cavity 40.

The first eartip 200 has an irregular hollow structure, and includes a first front portion 202, a first sidewall 201 and a first engagement portion 210. The first sidewall 201 defines the second sound channel 220. The first sidewall 201 has two opposite ends, i.e., a first end 203 and a second end 204. The first end 203 is configured to face the front cavity 40, the second end 204 is in contact with the front cover 120. The first front portion 202 and the first engagement portion 210 each extends from the first sidewall 201 towards the second sound channel 220. The first front portion 202 is spaced apart from the front cover 120 and is connected at the first end 203 of the first sidewall 201. The first engagement portion 210 extends from an inner surface of the first sidewall 201 and adjacent to the front cover 120. The first front portion 202 and the first engagement portion 210 define a first intermediate space 205 therebetween, and the first intermediate space 205 is configured to receive the engagement protrusion 127. In the first configuration, the first eartip 200 encircles the sound emitting nozzle 126, the inner surface of the first sidewall 201 is in contact with the outer surface of the sound emitting nozzle 126, and the first engagement portion 210 is engaged with the engagement protrusion 127, so that the first eartip 200 is stably assembled to the housing 100 to avoid the first eartip 200 to be detached from the sound emitting nozzle 126. The first engagement portion 210 is flexible and elastic. In the process of assembling the first eartip 200 to the housing 100, the first eartip 200 approaches the housing 100, the first engagement portion 210 becomes deformed until the engagement protrusion 127 is stuck in the first intermediate space 205. Because the engagement protrusion 127 is relatively hard and the first engagement portion 210 is relatively flexible, the first engagement portion 210 can be deformed and squeezed, thereby allowing the sound emitting nozzle to protrude into the second eartip 200 and making the engagement protrusion 127 be stuck in the first intermediate space 205. An interference fit is formed between the first engagement portion 210 and the outer surface of the sound emitting nozzle 126, thereby avoiding air passing between the first engagement portion 210 and the outer surface of the sound emitting nozzle 126. In another embodiment, the first eartip 200 may be made of a soft material such as rubber, resin, and silicon, and the first eartip 200 may be integrally formed.

Figure 13:
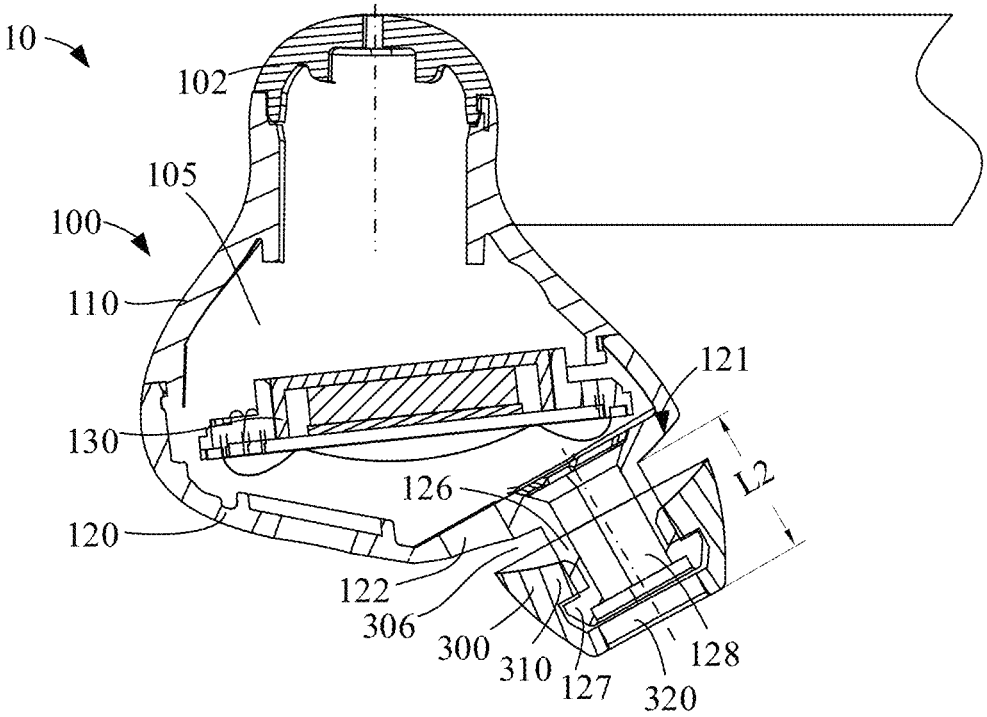
FIG. 13 illustrates a cross-sectional view of the earphone of FIG. 2, in accordance with an embodiment of the present disclosure.
Figure 14:
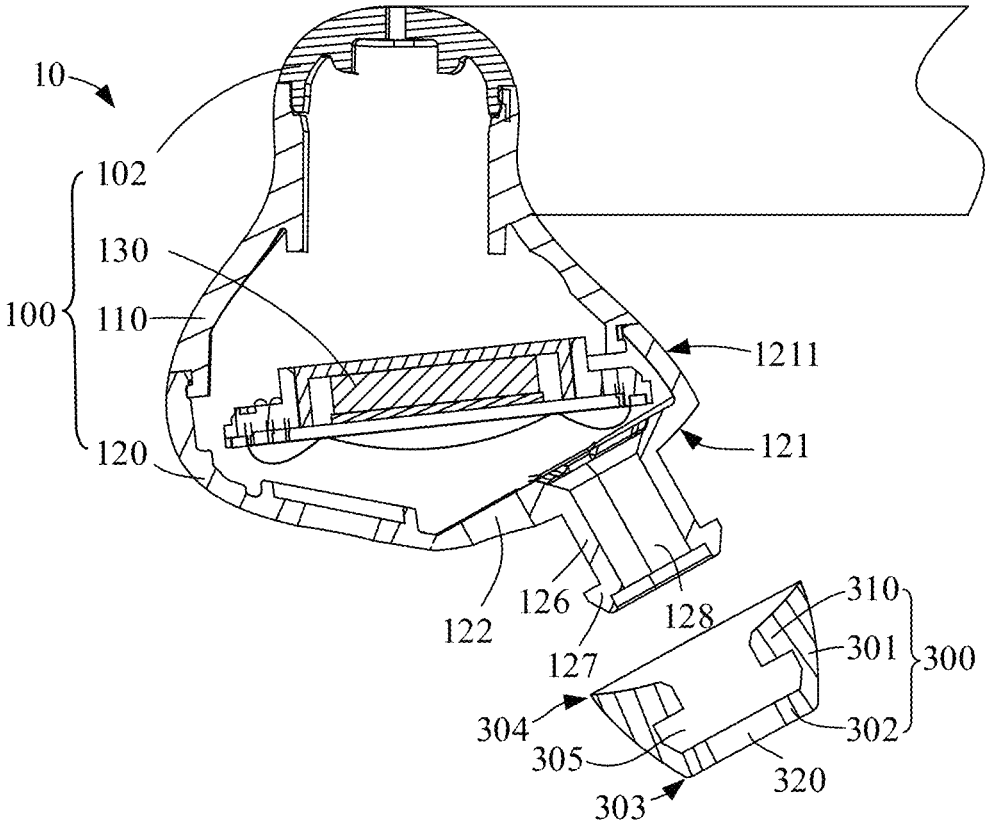
FIG. 14 illustrates a cross-sectional view of the earphone of FIG. 13, wherein the second eartip is apart from the housing.

As illustrated in FIGS. 13 and 14, the second eartip 300 can be mounted on and detached from the housing 100. The second eartip 300 defines a third sound channel 320 therein. When the second eartip 300 is mounted on the housing 100, the first sound channel 128 communicates with the third sound channel 320, so that the sounds emitted from the speaker 130 can pass through the first sound channel 128 and the third sound channel 320, and then can be transmitted to the outside of the earphone 10, for example, can be transmitted to the front cavity 40.

The second eartip 300 also is hollow, and may be substantially cylindrical in shape. The second eartip 300 includes a second front portion 302, a second sidewall 301 and a second engagement portion 310. The second sidewall 301 defines the third sound channel 320. The second sidewall 301 also has two opposite ends, i.e., a third end 303 and a fourth end 304. The third end 303 is configured to face the front cavity 40, the fourth end 304 faces the front cover 120. The second front portion 302 and the second engagement portion 310 each extends from the second sidewall 301 towards the third sound channel 320. The second front portion 302 is connected to the third end 303 of the second sidewall 301, the second engagement portion 310 extends from an inner surface of the second sidewall 301 and adjacent to the front cover 120. The second front portion 302 and the second engagement portion 310 define a second intermediate space 305 therebetween, and the second intermediate space 305 is configured to receive the engagement protrusion 127. In the second configuration, the second eartip 300 encircles the sound emitting nozzle 126, the inner surface of the second sidewall 301 is in contact with the outer surface of the sound emitting nozzle 126, and the second engagement portion 310 is engaged with the engagement protrusion 127, so that the second eartip 300 is stably assembled to the housing 100 to avoid the second eartip 200 to be detached from the sound emitting nozzle 126. The second engagement portion 310 is flexible and elastic. In the process of assembling the second eartip 300 to the housing 100, the second eartip 300 approaches the housing 100, the second engagement portion 310 becomes deformed and in contact with the engagement protrusion 127 until the engagement protrusion 127 is stuck in the second intermediate space 305. Because the engagement protrusion 127 is relatively hard and the second engagement portion 310 is relatively flexible, the second engagement portion 310 can be deformed and squeezed, thereby allowing the sound emitting nozzle 126 to protrude into the second eartip 300 and making the engagement protrusion 127 be stuck in the second intermediate space 305. An interference fit is formed between the second engagement portion 310 and the outer surface of the sound emitting nozzle 126, thereby avoiding air passing between the second engagement portion 310 and the outer surface of the sound emitting nozzle 126. In another embodiment, the second eartip 300 may be made of a soft material such as rubber, resin, and silicon, and the second eartip 300 may be integrally formed.

As illustrated in FIG. 11, the front cover 120 defines a vent hole 122 exposed from the end surface 121, that is, the vent hole 122 penetrates through the front cover 120 in a thickness direction of the front cover 120, which allows the air in the housing 100 to flow out. The vent hole 122 is adjacent to the sound emitting nozzle 126 but spaced apart, that is, a certain distance is defined therebetween. When the first eartip 200 is mounted on the housing 100, the first eartip 200 covers the end surface 121 and is in contact with the front cover 120. In particular, an outer surface of the first eartip 200 and the side surface 1211 of the front cover 120 may be smoothly connected thereby forming a smooth exterior shape. The vent hole 122 is covered by the first eartip 200. Preferably, the vent hole 122 is substantially sealed by the first eartip 200. An outer periphery of the second end 204 of the first eartip 200 fits an outer periphery of the end surface 121. In other words, an edge of the second end 204 of the first eartip 200 is in contact with an edge of the end surface 121. The first eartip 200 and the housing 100 form an integral shape. The first eartip 200 and the housing 100 corporately form a portion of an outer shape of the earphone 10. The first eartip 200 covers and/or seals the vent hole 122.

In some embodiments, the housing 100 defines a vent hole 122 exposed from the front cover 120, the vent hole 122 is covered and blocked when the first eartip 200 is mounted on the sound emitting nozzle 126, and the vent hole 122 is in communication with the exterior when the second eartip 300 is mounted on the sound emitting nozzle 126.

In the first configuration, the first eartip 200 is tightly sleeved on the sound emitting nozzle 126 of the housing 100, there is substantially no gap formed between the first eartip 200 and the sound emitting nozzle 126. The first eartip 200, the coupled portion 102, the rear case 110 and the front cover 120 form the outer shape of the earphone 10 which, works as the semi-in-ear earphone in the first configuration. The outer shape of the earphone 10, in the first configuration, is a smooth curved surface, that is, an outer diameter of the second end 204 matches with an outer diameter of the end surface 121, the second end 204 is tightly in contact with the end surface 121, and there is no gap formed between the second end 204 and the end surface 121. The outer diameter of the second end 204 is less than an outer diameter of the first end 203, and the outer diameter of the second end 204 is equal to the outer diameter of the end surface 121. As such, the first eartip 200 and the housing 100 constitute the earphone 10 which, works as the semi-in-ear earphone and may have better user experience by providing the soft first eartip 200 relative to conventional semi-in-ear earphones with a rigid structure.

In some embodiments, there is no visible end surface (e.g. the end surface 121) on the front cover 120. An edge of the second end 204 of the first eartip 200 is in contact with the surface of the front cover 120, so that the first eartip 200 and the housing 100 corporately form an integral shape. In other words, there is a smooth transition between the edge of the second end 204 and the front cover 120.

When the user wears the earphone 10 with the first eartip 200, at least part of the first eartip 200 is inserted into the auditory meatus 20 with a certain depth. The depth that the first eartip 200 extends in the auditory meatus 20 is relatively small, and the rest of the earphone 10, not inserted into the auditory meatus 20, still remains outside the auditory meatus 20. The earphone 10, in the first configuration, works as the semi-in-ear earphone, it may fit the auditory meatus 20 better by providing the soft first eartip 200 compared with the conventional semi-in-ear earphones with a rigid structure. And compared with the conventional semi-in-ear earphones, the first eartip 200 enters deeper into the auditory meatus 20. The first eartip 200 fits the auditory meatus 20 and can be deformed according to the shape of the auditory meatus 20, thereby providing a good sealing performance between the earphone 10 and the auditory meatus 20. In such condition, the airtightness of the front cavity 40 is better than that of conventional semi-in-ear headphones, and thus, the earphone 10 has a better sound insulation effect and a better low-frequency response in acoustic performance compared with conventional semi-in-ear earphones with a rigid structure. It is noted that the first eartip 200 may be designed in different sizes according to different sizes of the auditory meatus 20 of different people, so that the earphone 10 can be adapted to different people.

As illustrated in FIG. 13, an outside diameter of the first eartip 200 is smaller than that of the second eartip 300. When the second eartip 300 is mounted on the housing 100, an area surrounded by an outer periphery of the second eartip 300 is smaller than an area surrounded by an outer periphery of the end surface 121. The second eartip 300 is spaced apart from the end surface 121. Thus the vent hole 122 is exposed, and there is a gap 306 formed between the second eartip 300 and the end surface 121.

In some embodiments, when the first eartip 200 is assembled to the housing 100, a distance between the first end 203 of the first eartip 200 away from the housing 100 and the end surface 121 of the housing 100 is L1, as illustrated in FIG. 11. When the second eartip 300 is assembled on the housing 100, a distance between the third end 303 of the second eartip 300 away from the housing 100 and the end surface 121 of the housing 100 is L2, as illustrated in FIG. 13. L2 is greater than L1. Therefore, a depth that the first eartip 200 extends in the auditory meatus 20 is smaller than a depth that the second eartip 300 extends in the auditory meatus 20 when received in the auditory meatus 20.

In some embodiments, an outer diameter of the fourth end 304 is less than the outer diameter of the second end 204, the outer diameter of the third end 303 is substantially equal to or less than the outer diameter of the fourth end 304, and an outer diameter of the third end 303 is substantially equal to or less than the outer diameter of the first end 203.

When the user wears the earphone 10 with the second eartip 300, the second eartip 300 is substantially inserted into the auditory meatus 20. The depth that the second eartip 300 extends in the auditory meatus 20 is relatively larger compared with the depth that the first eartip 200 extends in the auditory meatus 20. The rest of the earphone 10 remains outside the auditory meatus 20. The second eartip 300 can fit the auditory meatus 20 and can be deformed according to the shape of the auditory meatus 20 to improve the comfort of the user. The vent hole 122 of the earphone 10 is not covered or blocked by the second eartip 300, the air in the housing 100 can flow out from the vent hole 122, so the airtightness of the front cavity 40 can be reduced, a problem of poor wearing experience caused by a difference of air pressure between the inside and the outside of the auditory meatus 20 can be solved, the airtightness and acoustic characteristics of the earphone 10 which, is equipped with the second eartip 300 and works as the in-ear earphone, may be substantially similar to that of the earphone 10 which, equipped with the first eartip 200 and works as the semi-in-ear earphone. That is, the sound qualities of the earphone 10 which, works as the semi-in-ear earphone or the in-ear earphone, are substantially the same. It is noted that, the second eartip 300 may be tightly fit the auditory meatus 20 compared with the first eartip 200, that is, the airtightness of the second eartip 300 with the auditory meatus 20 may be greater than the airtightness of the first eartip 200 with the auditory meatus 20 if there is no vent hole 122 defined therein. Even there is no vent hole provided in the earphone 10 equipped with the first eartip 200, the user may still feel comfortable. Moreover, the second eartip 300 may be designed in different sizes according to different sizes of the auditory meatus 20 of different people, so that the earphone 10 can be suitable for different people.

In one embodiment, a length of the first eartip 200 is greater than a length of the second eartip 300. The length of the first eartip 200 refers to a length of its two opposite ends of the first eartip 200 along the central axis thereof. The length of the second eartip 300 refers to a length of its two opposite ends of the second eartip 300 along the central axis thereof. A cross-sectional diameter of the second end 204 is larger than a cross-sectional diameter of the first end 203, and a cross-sectional diameter of the second end 204 is also larger than a cross-sectional diameter of the fourth end 304. In other words, a cross sectional size of the first eartip 200 is substantially greater than that of the second eartip 300, and a rear portion of the first eartip 200 is somewhat hardly to be inserted into the auditory meatus 20 of the user.

In another embodiment, a thickness of the first front portion 202 is less than or equal to a thickness of the second front portion 302. Alternatively, a thickness of the first intermediate space 205, along a direction parallel to the central axis of the first eartip 200, is substantially the same as a thickness of the engagement protrusion 127; and a thickness of the second intermediate space 305, along a direction parallel to the central axis of the second eartip 300, is greater than the thickness of the engagement protrusion 127. In other words, there may be a gap formed between the engagement protrusion 127 and the second front portion 302. When the first eartip 200 is assembled to the housing 100, the distance between the first end 203 of the first eartip 200 away from the housing 100 and the end surface 121 of the housing 100 is L1, as illustrated in FIG. 11. When the second eartip 300 is assembled on the housing 100, the distance between the third end 303 of the second eartip 300 away from the housing 100 and the end surface 121 of the housing 100 is L2, as illustrated in FIG. 13. L2 is greater than or equal to L1, which means an insertion distance of the earphone 10 quipped with the second eartip 300 can be greater than an insertion distance of the earphone 10 equipped with the first eartip 200.

It is noted that the sound emitting nozzle 126 may include other engagement portions other than the engagement protrusion 127, for example, the sound emitting nozzle 126 may include one or more slots, one or more bumps, one or more fixtures, to selectively engage with the first eartip 200 or the second eartip 300. The engagement portion is positioned between the first front portion 202 and the front cover 120 when the first eartip 200 is mounted on the sound emitting nozzle 126; and the engagement portion is positioned between the second front portion 302 and the front cover 120 when the second eartip 300 is mounted on the sound emitting nozzle 126. The thickness of the second front portion 302 is greater than the thickness of the first front portion 202. In other words, the second eartip 300 protrudes from the engagement portion with a longer length than the first eartip 200.

In still another embodiment, there is no visible end surface (e.g. the end surface 121) on the front cover 120. When the first eartip 200 is assembled to the housing 100, the minimum distance between the first end 203 of the first eartip 200 away from the housing 100 and the front cover 120 of the housing 100 is L1. When the second eartip 300 is assembled to the housing 100, the minimum distance between the first end 203 of the first eartip 200 away from the housing 100 and the front cover 120 of the housing 100 is L2. L2 is greater than or equal to L1, which means an insertion distance of the earphone 10 quipped with the second eartip 300 can be greater than an insertion distance of the earphone 10 equipped with the first eartip 200.

In yet another embodiment, the sound emitting nozzle 126 protrudes from the end surface 121 of the front cover 120, the vent hole 122 is defined in a sidewall of the sound emitting nozzle 126 and is adjacent to the end surface 121. When the first eartip 200 is mounted on the housing 100, the vent hole 122 is covered and sealed by the first eartip 200.

The airtightness of the front cavity 40 is better than that of conventional semi-in-ear headphones, and thus, the earphone 10 has a better sound insulation effect and a better low-frequency response in acoustic performance. When the second eartip 300 is mounted on the housing 100, the vent hole 122 is not sealed by the second eartip 300 and is exposed. That is, the vent hole 122 is not covered or sealed by the second eartip 300, so that the air in the first sound channel 128 can flow out from the vent hole 122, so the airtightness of the front cavity 40 can be reduced, a problem of poor wearing experience caused by a difference of air pressure between the inside and the outside of the auditory meatus 20 can be solved, the airtightness and acoustic characteristics of the earphone 10 which, is equipped with the second eartip 300 and works as the in-ear earphone, can be substantially similar to that of the earphone 10 which, equipped with the first eartip 200 and works as the semi-in-ear earphone. That is, the sound qualities of the earphone 10 which, works as the semi-in-ear earphone or the in-ear earphone, are substantially the same. In some embodiments, the sound qualities of the earphone 10 which, works as the semi-in-ear earphone or the in-ear earphone, are different. the airtightness and acoustic characteristics of the earphone 10 which, is equipped with the second eartip 300 and works as the in-ear earphone, can be different to that of the earphone 10 which, equipped with the first eartip 200 and works as the semi-in-ear earphone. For example, the airtightness and acoustic characteristics of the earphone 10 which, is equipped with the second eartip 300 and works as the in-ear earphone, can be better than that of the earphone 10 which, equipped with the first eartip 200 and works as the semi-in-ear earphone. Meanwhile, the wearing comfort of the first eartip 200 may be better than that of the second eartip 300.

Figure 15:
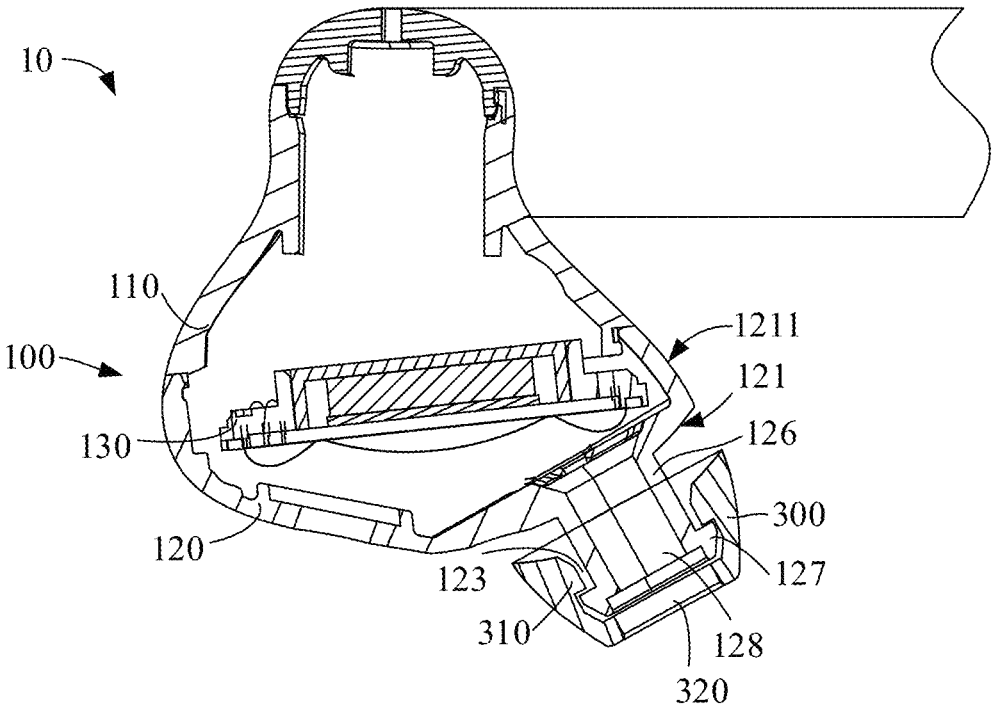
FIG. 15 illustrates a cross-sectional view of the earphone of FIG. 2, in accordance with another embodiment of the present disclosure.

As illustrated in FIG. 15, in yet another embodiment, the vent channel is a gap defined between the second eartip 300 and the housing 100. When the second eartip 300 is mounted on the housing 100, the second engagement portion 310 is engaged with the engagement protrusion 127. There is a gap 123 defined between the second engagement portion 310 and the sidewall of the sound emitting nozzle 126. The gap 123 functions as the vent channel for air to flow through. The airtightness between the second eartip 300 and the sound emitting nozzle 126 may be reduced via the gap 123. So that the air in the housing 100 can pass through the first sound channel 128, the third sound channel 320, and the gap 123 in sequence and flow out, thereby reducing the airtightness of the front cavity 40, and solving the problem of poor wearing experience caused by the difference in air pressure between the inside and the outside of the auditory meatus 20. The airtightness and acoustic characteristics of the earphone 10 which, is equipped with the second eartip 300 and works as the in-ear earphone, can be substantially similar to that of the earphone 10 which, equipped with the first eartip 200 and works as the semi-in-ear earphone. Therefore, the sound qualities of the earphone 10 that works as the semi-in-ear earphone and the in-ear earphone are substantially the same. It should be noted that, the third sound channel 320 may also mean the inner space 105 of the earphone 10.

Figure 16:
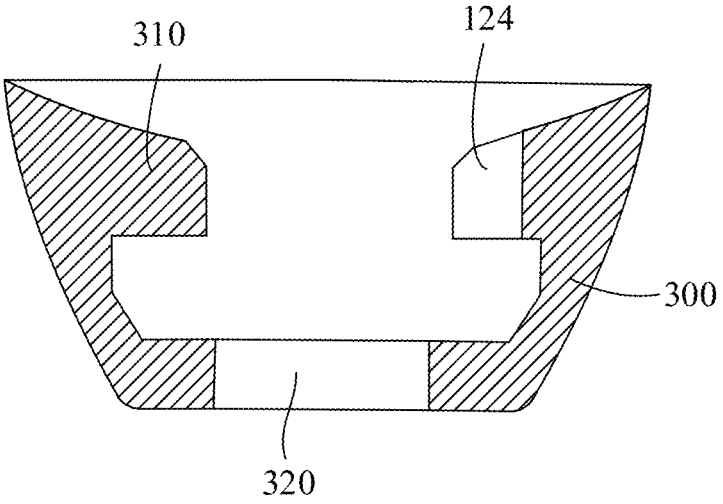
FIG. 16 illustrates a cross-sectional view of the second eartip of the earphone of FIG. 2, in accordance with another embodiment of the present disclosure.
Figure 17:
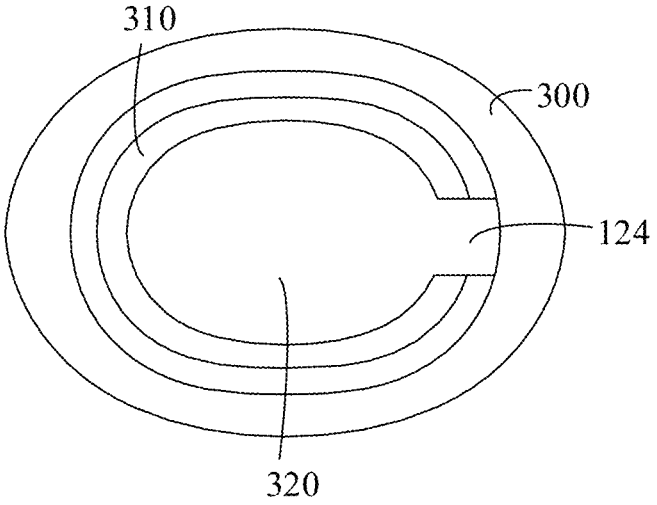
FIG. 17 illustrates a top view of the second eartip of FIG. 16.

In still yet another embodiment, the vent channel is a notch defined in the second eartip 300. As illustrated in FIG. 16 and FIG. 17, the second engagement portion 310 of the second eartip 300 defines a notch 124 therein. When the second eartip 300 is mounted on the housing 100, the second engagement portion 310 is engaged with the engagement protrusion 127. The notch 124 in the second engagement portion 310 functions as the vent channel for air to flow through. So that the air in the housing 100 can pass through the first sound channel 128, the third sound channel 320, and the notch 124 in sequence and flow out, thereby reducing the airtightness of the front cavity 40, and solving the problem of poor wearing experience caused by the difference in air pressure between the inside and outside the auditory meatus 20. The airtightness and acoustic characteristics of the earphone 10 which, is equipped with the second eartip 300 and works as the in-ear earphone, can be substantially similar to that of the earphone 10 which, equipped with the first eartip 200 and works as the semi-in-ear earphone. Therefore, the sound qualities of the earphone 10 that works as the semi-in-ear earphone and the in-ear earphone are substantially the same.

In some embodiments, the first eartip 200 may be made of a soft material, and compared with the conventional semi-in-ear earphones, the first eartip 200 enters deeper into the auditory meatus 20, so that it fits better into the auditory meatus 20 than conventional semi-in-ear headphones. And when the second eartip 300 is assembled to the housing 100, the depth that the earphone 10 extends in the auditory meatus 20 is smaller than that of a conventional in-ear earphone. So that the problem of intrusive feeling when the user wears the earphone 10 can be weakened. But when the second eartip 300 is assembled to the housing 100, the depth that the earphone 10 extends in the auditory meatus 20 is greater than that of when the first eartip 200 is assembled to the housing 100, in other words, the second eartip 300 fits better into the auditory meatus 20 than the first eartip 200. Meanwhile, the vent hole/vent channel shall not be sealed, when the second eartip 300 is assembled to the housing 100, so that a problem of poor wearing experience caused by a difference of air pressure between the inside and the outside of the auditory meatus 20 can be solved. People can choose different eartip according to their preferences or their own wearing habits.

In some embodiments, the first eartip 200 may be same as the conventional semi-in-ear earphones when the first eartip 200 is assembled to the housing 100, and the second eartip 300 may be same as the conventional in-ear earphone when the second eartip 300 is assembled to the housing 100.

In the earphone 10 provided by the present disclosure, the first eartip 200 and the second eartip 300 having different sizes and shapes can be detachably mounted on the housing 100. An insertion depth of the earphone 10 is different by using the first eartip 200 or the second eartip 300. So that the earphone 10 can be used as a semi-in-ear earphone or an in-ear earphone, the acoustic characteristics of the front cavity 40 can be adjusted accordingly, thereby adjusting the acoustic performance of the headphones 10. When the first eartip 200 is mounted on the housing 100, the earphone 10 works as a semi-in-ear earphone. When the user wears the earphone 10 with the first eartip 200, the first eartip 200 is inserted into the auditory meatus 20, the first eartip 200 does not generate pressure on the auditory meatus 20 and is not easily fall off so the user experience is good. When the first eartip 200 is received in the auditory meatus 20, the first eartip 200 can cooperate well with the auditory meatus 20, thereby achieving a good sound insulation, making a good airtightness of the front cavity 40, and improving the acoustic performance of the earphone 10. When the second eartip 300 is mounted on the housing 100, the earphone 10 works as an in-ear earphone. When the user wears the earphone 10 with the second eartip 300, the second eartip 300 is inserted into the auditory meatus 20, which does not generate pressure on the auditory meatus 20 and is not easy to detach from the auditory meatus 20, and the user experience is better. The second eartip 300 can reduce the airtightness of the front cavity 40 via the air vent hole 122 or the air vent channel, thereby avoiding a pressure difference between the auditory meatus 20 and the outside world, and thereby avoiding an echo of the sound when speaking. Therefore an openness of the sound quality of the earphone 10 is improved. When the second eartip 300 is assembled to the housing 100, the depth that the earphone 10 extends in the auditory meatus 20 is smaller than that of a common in-ear earphone. So that the problem of intrusive feeling when the user wears the earphone 10 can be weakened. The airtightness of the front cavity 40 that is defined by the earphone 10 with the first eartip 200 is substantially approximate to the airtightness of the front cavity 40 that is defined by the earphone 10 with the second eartip 300. So that the earphone 10 may have similar acoustic characteristics in both conditions of the earphone 10 when equipped with the first eartip 200 and the second eartip 300. The sound qualities of both the two conditions are not easily affected.

The technical features of the embodiments described above can be arbitrarily combined. In order to simplify the description, all possible combinations of the technical features in the above embodiments have not been described. However, as long as there is no contradiction in the combination of these technical features, it should be considered as the scope described in this specification.

The above-mentioned embodiments only express several implementation manners of the present disclosure, and their descriptions are more specific and detailed, but they cannot be understood as a limitation on the scope of patent disclosure. It should be noted that, for those of ordinary skill in the art, without departing from the concept of the present disclosure, several modifications and improvements can be made, which all belong to the protection scope of the present disclosure. Therefore, the protection scope of this disclosure patent shall be subject to the appended claims.

What is claimed is:

1. An earphone, comprising:

a housing, defining an inner space;

a first eartip, configured to be detachably mounted on the housing; and a second eartip, configured to be detachably mounted on the housing;

wherein the housing is selectively cooperated with one of the first eartip and the second eartip, the earphone defines a vent channel, the vent channel is in communication with the inner space and an exterior of the earphone when the second eartip is mounted on the housing, the vent channel is blocked when the first eartip is mounted on the housing, and a structure of the first eartip is different from a structure of the second eartip.

2. The earphone according to claim 1, wherein the earphone has a structure of a semi-in-ear earphone when the first eartip is mounted on the housing, and the earphone has a structure of an in-ear earphone when the second eartip is mounted on the housing.

3. The earphone according to claim 1, wherein the second eartip fits an auditory meatus more tightly when inserted into the auditory meatus than the first eartip when inserted into the auditory meatus.

4. The earphone according to claim 1, wherein the housing comprises a front cover and a sound emitting nozzle protruded from the front cover towards a direction away from the front cover;

wherein the first eartip comprises a first end and a second end, the first end is configured to be inserted into an auditory meatus, the second end is opposite to the first end; the second eartip comprises a third end and a fourth end, the third end is configured to be inserted into the auditory meatus, the fourth end is opposite to the third end;

wherein a minimum distance between the first end and the front cover is represented as L1 when the first eartip is assembled on the sound emitting nozzle, a distance between the third end and the front cover is represented as L2 when the second eartip is assembled on the sound emitting nozzle, and L2 is greater than L1.

5. The earphone according to claim 1, wherein the housing comprises a front cover and a sound emitting nozzle, the sound emitting nozzle protrudes from the front cover towards a direction away from the front cover, the front cover is in contact with the first eartip when the first eartip is mounted on the sound emitting nozzle of the housing, and the front cover is spaced apart from the second eartip when the second eartip is mounted on the sound emitting nozzle of the housing.

6. The earphone according to claim 5, wherein the front cover has an end surface, the sound emitting nozzle extends from the end surface, the first eartip comprises a first end and a second end, the first end is away from the end surface and the second end is adjacent to the end surface when the first eartip is mounted on the sound emitting nozzle; the second eartip comprises a third end and a fourth end, the third end is away from the end surface and the fourth end is adjacent to the end surface when the second eartip is mounted on the sound emitting nozzle;

wherein a distance between the first end and the end surface is represented as L1 when the first eartip is mounted on the sound emitting nozzle, a distance between the third end and the end surface is represented as L2 when the second eartip is mounted on the sound emitting nozzle, and L2 is greater than L1.

7. The earphone according to claim 5, the front cover has an end surface, the sound emitting nozzle extends from the end surface, wherein the first eartip comprises a first end and a second end, the first end is away from the end surface and the second end is adjacent to the end surface when the first eartip is mounted on the sound emitting nozzle; the second eartip comprises a third end and a fourth end, the third end is away from the end surface and the fourth end is adjacent to the end surface when the second eartip is mounted on the sound emitting nozzle;

wherein an edge of the second end fits and is in contact with an edge of the end surface of the front cover when the first eartip is mounted on the sound emitting nozzle, an outer diameter of the second end is substantially equal to an outer diameter of the end surface, and a gap is defined between the fourth end and the end surface when the second eartip is mounted on the sound emitting nozzle.

8. The earphone according to claim 5, wherein the front cover has an end surface, the sound emitting nozzle extends from the end surface, the vent channel is a vent hole exposed in the end surface, the vent hole is covered and blocked when the first eartip is mounted on the sound emitting nozzle, and the vent hole is in communication with the exterior when the second eartip is mounted on the sound emitting nozzle.

9. The earphone according to claim 5, wherein the vent channel is a vent hole defined in the sound emitting nozzle, the vent hole is in communication with a first sound channel, the vent hole is covered and blocked when the first eartip is mounted on the sound emitting nozzle, and the vent hole is in communication with the exterior when the second eartip is mounted on the sound emitting nozzle.

10. The earphone according to claim 5, wherein the vent channel is a gap defined between a sidewall of the sound emitting nozzle and a sidewall of the second eartip when the second eartip is mounted on the sound emitting nozzle, and the sidewall of the sound emitting nozzle is in contact with a sidewall of the first eartip when the first eartip is mounted on the sound emitting nozzle.

11. The earphone according to claim 5, wherein an engagement protrusion is provided at an end of the sound emitting nozzle, the first eartip comprises a first engagement portion, the first engagement portion is configured to engage with the engagement protrusion when the first eartip is mounted on the sound emitting nozzle, the second eartip comprises a second engagement portion, the second engagement portion is configured to engage with the engagement protrusion when the second eartip is mounted on the sound emitting nozzle.

12. The earphone according to claim 11, wherein the vent channel is a notch defined in the second engagement portion.

13. The earphone according to claim 1, wherein the housing comprises a body and a sound emitting nozzle protruded from the body towards a direction away from the body, the sound emitting nozzle comprises an engagement portion, the engagement portion is configured to selectively engage with the first eartip or the second eartip;

wherein a first eartip comprises a first front portion, the engagement portion is positioned between the first front portion and a front cover when the first eartip is mounted on the sound emitting nozzle;

wherein the second eartip comprises a second front portion, the engagement portion is positioned between the second front portion and the front cover when the second eartip is mounted on the sound emitting nozzle; wherein a thickness of the second front portion is greater than a thickness of the first front portion.

14. The earphone according to claim 1, wherein a length of the first eartip is greater than a length of the second eartip.

15. The earphone according to claim 1, wherein the first eartip comprises a first end and a second end, the first end is configured to be inserted into an auditory meatus, the second end is opposite to the first end; the second eartip comprises a third end and a fourth end, the third end is configured to be inserted into the auditory meatus, the fourth end is opposite to the third end; a cross-sectional diameter of the second end is greater than a cross-sectional diameter of the first end, and the cross-sectional diameter of the second end is greater than a cross-sectional diameter of the fourth end.

16. The earphone according to claim 11, wherein the first eartip further comprises a first front portion and a first sidewall, the first front portion and the first engagement portion each protrude from the first sidewall towards a first sound channel, a first intermediate space is defined between the first front portion and the first engagement portion, the engagement protrusion is stuck in the first intermediate space when the first eartip is mounted on the sound emitting nozzle;

wherein the second eartip further comprises a second front portion and a second sidewall, the second front portion and the second engagement portion each protrude from the second sidewall towards a second sound channel, a second intermediate space is defined between the second front portion and the second engagement portion, the engagement protrusion is stuck in the second intermediate space when the second eartip is mounted on the sound emitting nozzle;

wherein the housing further comprises a coupled portion, a rear case and a front cover, the rear case is coupled between the coupled portion and the front cover, the coupled portion, the rear case and the front cover cooperatively define the inner space, and a speaker is disposed in the inner space and faces the first sound channel; a central axis of the sound emitting nozzle intersects with a central axis of the coupled portion, and the central axis of the sound emitting nozzle intersects with a central axis of the speaker.

17. An earphone, comprising:

a housing, comprising a front cover and a sound emitting nozzle connected with the front cover, the front cover comprising an end surface, the sound emitting nozzle protruding from the end surface towards a direction away from the front cover, the housing defining an inner space therein;

a first eartip, configured to be mounted on the sound emitting nozzle; and a second eartip, configured to be mounted on the sound emitting nozzle, the earphone having a vent channel when the second eartip is mounted on the sound emitting nozzle, and the vent channel being blocked when the first eartip is mounted on the sound emitting nozzle;

wherein the housing is selectively cooperated with one of the first eartip and the second eartip, a structure of the first eartip is different from a structure of the second eartip; and a gap is defined between the second eartip and the end surface when the second eartip is mounted on the sound emitting nozzle.

18. The earphone according to claim 17, wherein the first eartip comprises a first end and a second end, the first end is away from the end surface and the second end is adjacent to the end surface when the first eartip is mounted on the sound emitting nozzle; the second eartip comprises a third end and a fourth end, the third end is away from the end surface and the fourth end is adjacent to the end surface when the second eartip is mounted on the sound emitting nozzle; a distance between the first end and the end surface is represented as L1 when the first eartip is mounted on the sound emitting nozzle, a distance between the third end and the end surface is represented as L2 when the second eartip is mounted on the sound emitting nozzle, and L2 is greater than L1.

19. An earphone adapted with an auditory meatus, comprising:

a housing, comprising a body and a sound emitting nozzle protruded from the body towards a direction away from the body, the body defining an inner space therein;

a first eartip, configured to engage with the sound emitting nozzle; and a second eartip, configured to engage with the sound emitting nozzle;

wherein the earphone has a first use state and a second use state;

in the second state, the second eartip engages with the sound emitting nozzle, the earphone works as an in-ear earphone, and a vent channel is provided to communicate with the inner space and an exterior of the earphone;

in the first state, the first eartip engages with the sound emitting nozzle, the earphone works as a semi-in-ear earphone;

wherein a structure of the first eartip is different from a structure of the second eartip, and a distance of the first eartip inserted into the auditory meatus in the first state is less than a distance of the second eartip inserted into the auditory meatus in the second state.

20. The earphone according to claim 19, wherein the second eartip fits the auditory meatus more tightly when inserted into the auditory meatus than the first eartip when inserted into the auditory meatus.

* * * * *